US007728755B1

(12) United States Patent
Jocic

(10) Patent No.: US 7,728,755 B1
(45) Date of Patent: Jun. 1, 2010

(54) REACTIVE PARALLEL PROCESSING JAMMING SYSTEM

(75) Inventor: Damjan Jocic, 733-5$^{th}$ Avenue, Verdun Quebec H4G 2Z4 (CA)

(73) Assignee: Damjan Jocic, Verdun, Québec (CA)

( * ) Notice: Subject to any disclaimer, the term of this patent is extended or adjusted under 35 U.S.C. 154(b) by 1114 days.

(21) Appl. No.: 11/374,175

(22) Filed: Mar. 14, 2006

Related U.S. Application Data

(60) Provisional application No. 60/661,911, filed on Mar. 16, 2005.

(51) Int. Cl.
*H04K 3/00* (2006.01)

(52) U.S. Cl. ..... 342/20; 375/130; 375/140; 375/144; 375/148; 342/13; 342/14; 342/15; 342/194

(58) Field of Classification Search ..... 375/130, 375/140, 144, 148; 342/13–15, 20, 194; 455/1

See application file for complete search history.

(56) References Cited

U.S. PATENT DOCUMENTS

| | | | | |
|---|---|---|---|---|
| 4,017,856 | A | 4/1977 | Wiegand | |
| 4,575,724 | A * | 3/1986 | Wiener | 342/383 |
| 4,719,649 | A | 1/1988 | Woodsum et al. | |
| 5,001,771 | A | 3/1991 | New | |
| 5,048,015 | A * | 9/1991 | Zilberfarb | 370/312 |
| 5,200,753 | A | 4/1993 | Janusas | |
| 5,259,030 | A * | 11/1993 | Francis | 375/346 |
| 5,313,209 | A | 5/1994 | Michaels, Jr. et al. | |
| 5,349,609 | A * | 9/1994 | Tsujimoto | 375/347 |
| 5,974,101 | A * | 10/1999 | Nago | 375/350 |
| 6,118,805 | A * | 9/2000 | Bergstrom et al. | 375/132 |
| 6,157,840 | A * | 12/2000 | Hogberg et al. | 455/452.2 |
| 6,476,755 | B1 | 11/2002 | Senio et al. | |
| 6,697,008 | B1 | 2/2004 | Sternowski | |
| 2004/0263378 | A1 * | 12/2004 | Jossef et al. | 342/20 |

* cited by examiner

*Primary Examiner*—David C Payne
*Assistant Examiner*—Leon Flores
(74) *Attorney, Agent, or Firm*—Ogilvy Renault, LLP

(57) ABSTRACT

The system is a parallel processing jamming architecture that is designed to automatically attack and concurrently investigate multiple signals simultaneously in the radio environment. The system implements multiple wideband independent channels to allow simultaneous threat signals to be processed in parallel and jammed in real-time. The system automatically attacks a radio communication channel when the suspect radio signal surpasses a dynamic composite threshold which is internally updated using multi-channel data feedback, in real-time. The concurrent analysis with transmission allows the system to optimize the jam efficiency quickly to an unknown signal, and while determining the validity of the threat. The high throughput parallel architecture allows the intelligent jamming process to occur with rapidity and signal multiplicity.

20 Claims, 7 Drawing Sheets

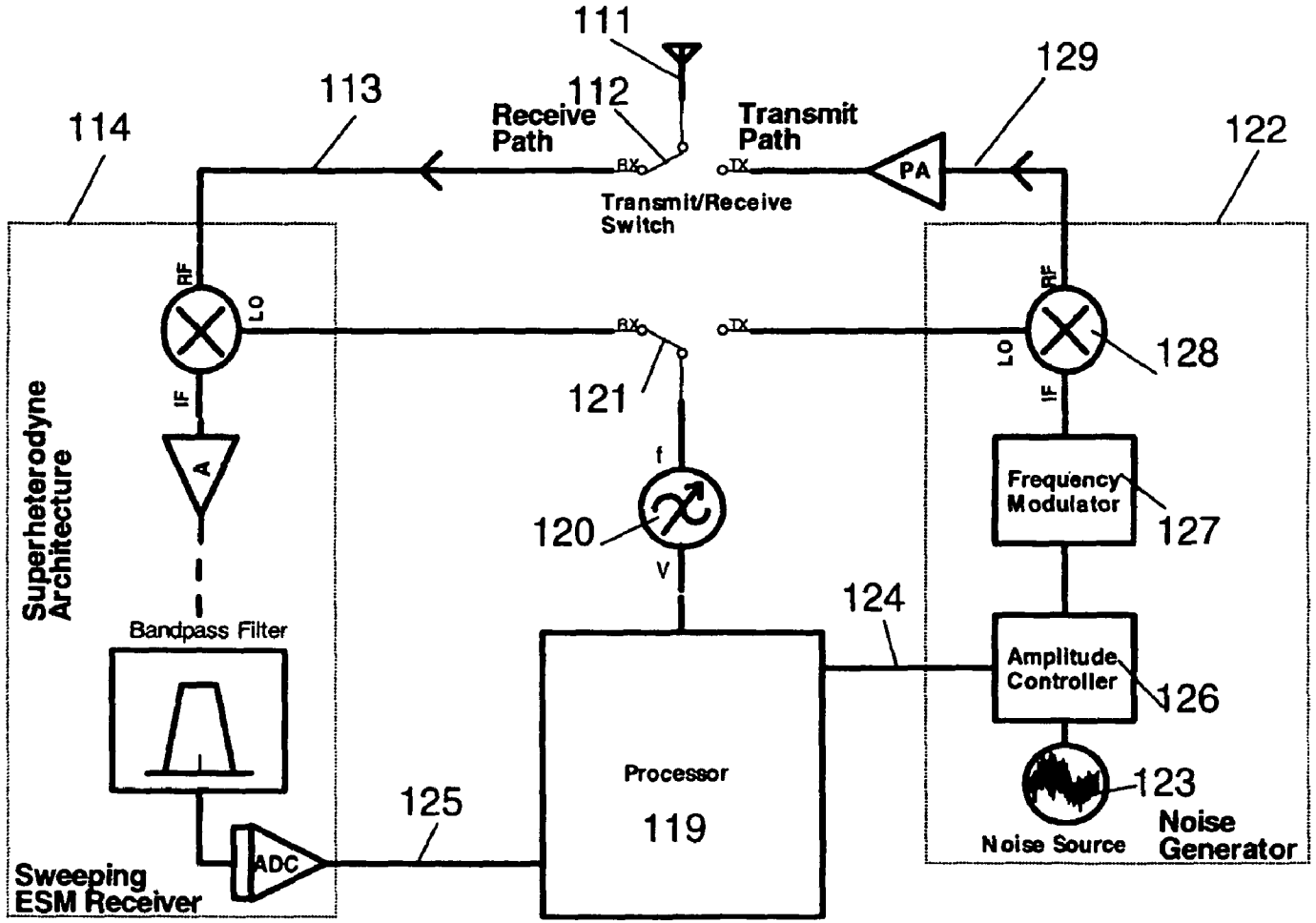
FIGURE 6 - *(PRIOR ART)*

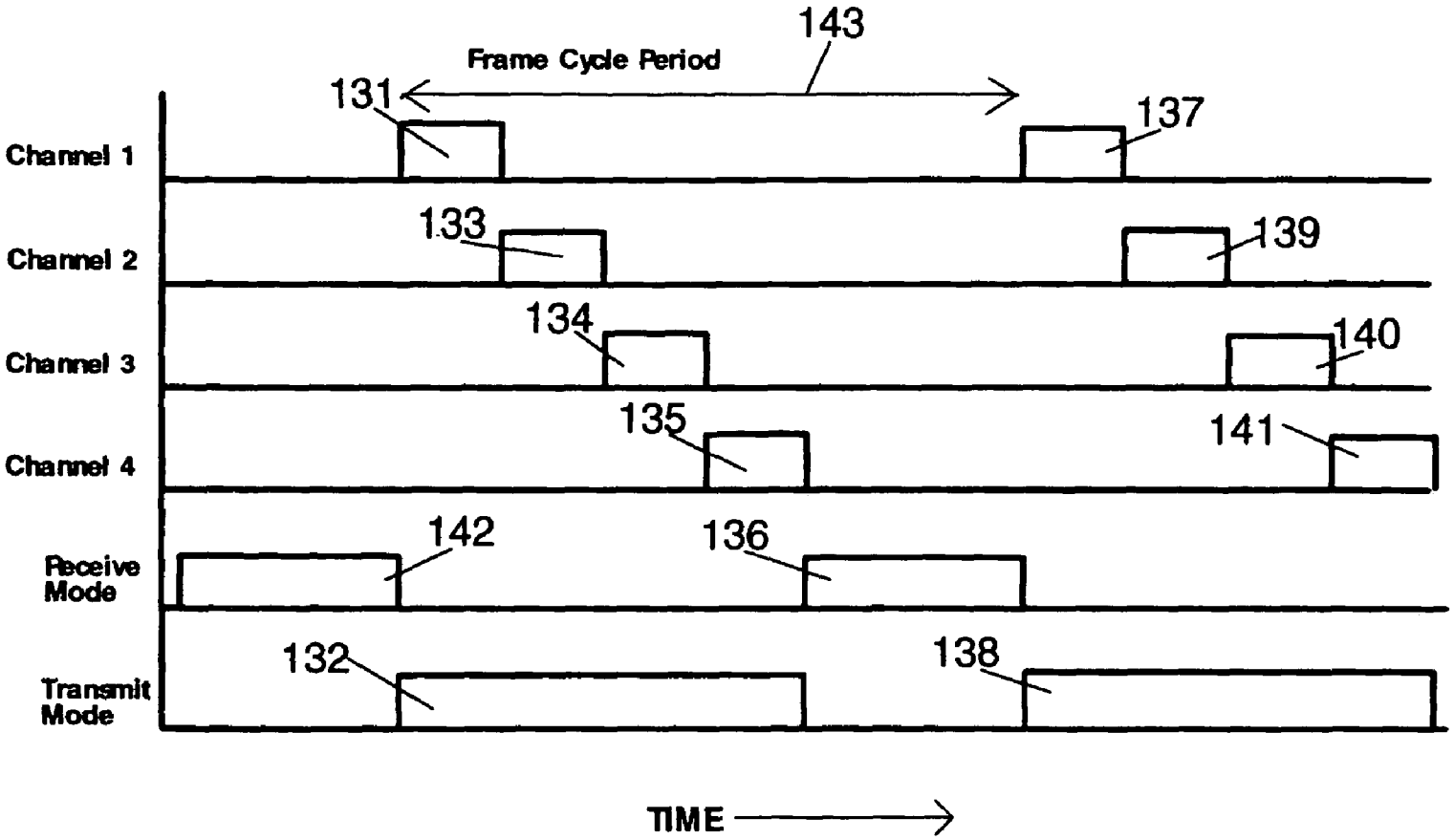
FIGURE 7 - *(PRIOR ART)*

REACTIVE PARALLEL PROCESSING JAMMING SYSTEM

CROSS-REFERENCE TO RELATED APPLICATIONS

The present invention claims priority of US Provisional Patent Application bearing Ser. No. 60/661,911 filed on Mar. 16, 2005 and entitled "Reactive Parallel Processing Jammer".

FIELD OF THE INVENTION

The invention pertains to the field of electronic countermeasures used to receive and intentionally disrupt communication signals by use of interfering transmissions directed against a hostile communications receiver, such as the disruption of a command signal sent to a hostile roadside radio control incendiary device.

BACKGROUND OF THE INVENTION

In order for a jamming system to respond to the plethora of commercially made radio control devices, the jamming system must cover a considerable bandwidth from 20 to 2500 MHz and beyond in a very short period of time. Almost any commercially made radio device, whether it be a hobby radio, garage door opener, cellular telephone or a handie-talkie for example, can be with little technical knowledge fashioned into a threat device. These devices operate in various parts of the spectrum, using different modulation formats, protocols and intelligence. To assign a receiver for each frequency where every commercial device operates would not only be impractical but very costly. Furthermore, there still needs to be a mechanism to decide quickly whether to attack the signal or leave it alone.

For a jamming system to be effective in the urban environment for policing protection and intervention, several primary requirements need to be met. (1) The system should jam both hostile voice/data communication equipment and also accommodate the larger growing threat of radio control devices being used to detonate explosives by a hostile force during, for example, a motorcade escort. On this point alone, prior art systems fail primarily because the jam algorithms are not properly tailored to the target device and as a result either premature actuation of the explosive will result or ineffective jamming will prevail. (2) The system should jam radio signals surreptitiously. Very few people in the urban neighborhood should be alerted to the presence of the jamming equipment when transmitting, particularly the terrorist, and therefore it should be selective about which frequencies it must jam as well as how long the jammer can transmit. (3) The system should be real-time adaptable to the multiplicity of radio signals received in the urban environment to accommodate a variety of radio control and communication signal threats. (4) Coverage of the radio spectrum should be continuous and as widebanded as possible since the threat may occur at any time and at any frequency unbeknown to the operator of the system. If the system is reactive in nature, the reaction time must be faster than the time it takes for a commercially marketed radio control device to decode a command from the moment of initiation. (5) The system should be easy to transport. (6) The system should be easy to operate. (7) The system should not be costly.

In many ways the requirements put forth for jamming radio control devices are even more demanding than a conventional communication jammer since if the hostile transmission is not properly addressed it is not simply a voice instruction that is missed, but moreover, perhaps a loss of life and property. If the system can handle radio control devices, voice/data communication jamming can also be handled.

In the prior art, the known architectures do not show the necessary versatility and operational efficiency to function in the urban environment for policing protection against the aforementioned threats in real-time. The "barrage" jamming method, where jamming noise is radiated indiscriminately across a very wide radio spectrum, fails on requirements 1, 2, 3, 6 and 8. "Selective" jamming, which concentrates the jamming noise into multiple narrow spectral bandwidths, fails on requirements 1, 3 and 4. Known reactive jamming architectures, which introduce a receiver to guide the jammer, fail on requirements 1, 3, 5 and 7. Many of these techniques are described in more detail in electronic warfare literature such as "Electronic Countermeasures", Peninsula Publishing, Chp. 6, 7 and 12, 1979, ISBN-0-932146-00-7.

Therefore, there is a need for improved jamming methods that can meet a majority of the above-listed criteria.

SUMMARY OF THE INVENTION

In accordance with a first broad aspect of the present invention, there is provided a method for jamming signals, the method comprising: scanning a spectrum and comparing detected signals in the spectrum to a threshold; identifying a signal which exceeds the threshold as a potential threat; sending a first response jam signal to the signal identified as a potential threat; analyzing the signal identified as a potential threat to further determine whether the signal is a hostile signal; and formulating, based on the analysis, a jamming algorithm for the hostile signal, generating an optimized jamming signal using the jamming algorithm, and transmitting the optimized jamming signal in replacement of the first response jam signal.

In accordance with a second broad aspect of the present invention, there is provided a system for jamming signals, the system comprising: at least one receiving/transmitting module; a control module for receiving data from the receiving/transmitting module and adapted to scan, from the data, an operational spectrum, and identify a signal as a potential threat based on the signal exceeding a threshold; and at least one channel processor module adapted to transmit a first response jam signal to temporarily neutralize the signal identified as a potential threat, analyze the signal to further determine whether the signal is a hostile signal, formulate a jamming algorithm for the signal if the signal identified as a potential threat is found to be a hostile signal, generate an optimized jamming signal using the jamming algorithm, and transmit the optimized jamming signal in replacement of the first response jam signal using the receiving/transmitting module.

In accordance with a third broad aspect of the present invention, there is provided a method for jamming signals, the method comprising: scanning a spectrum and comparing detected signals in the spectrum to a threshold; identifying as potential threats a plurality of signals that exceed a threshold; and transmitting in parallel first response jam signals to neutralize the plurality of signals identified as potential threats.

In accordance with a fourth broad aspect of the present application, there is provided a system for jamming signals, the system comprising: at least one receiving/transmitting module; a control module for receiving data from the receiving/transmitting module and adapted to scan, from the data, an operational spectrum, and identify signals as potential threats based on the signals exceeding a threshold; and a plurality of channel processor modules instructed individually by the control module to transmit in parallel first response jam signals to temporarily neutralize the signals identified as potential threats, using the receiving/transmitting module.

In a preferred embodiment, the system is a parallel processing jamming architecture that is designed to automatically attack and concurrently investigate multiple signals simultaneously in the radio environment. The system implements multiple wideband independent channels to allow simultaneous threat signals to be processed in parallel and jammed in real-time. The system automatically attacks a radio communication channel when the suspect radio signal surpasses a dynamic composite threshold which is internally updated using multi-channel data feedback, in real-time. The concurrent analysis with transmission allows the system to optimize the jam efficiency quickly to an unknown signal and while determining the validity of the threat. The high throughput parallel architecture allows the intelligent jamming process to occur with rapidity and signal multiplicity. The invention overcomes many of the shortcomings of prior art when operating in the real world environment of radio signal multiplicity and dynamics.

The system uses one "Course Track and Lock Receiver" (CTLR) which scans the entire operational spectrum and initially detects a threat signal based on the received signal surpassing a composite threshold. The CTLR then hands off information about a detected target to one of the many "Channel Processor Modules" (CPMs). Upon hand off the selected CPM will immediately strike the target frequency with a general noise algorithm jam signal and then the CPM optimizes the jam algorithm while it receives and analyzes the target signal. Each CPM is a self-contained independent block of circuitry based on standard Digital Signal Processing technology and is capable of wide bandwidth reception, demodulation, intelligence analysis, noise algorithm formulation, remodulation and a low power level jam transmission. The low power level jam signal outputs from each CPM are then combined using a wideband RF combiner, then the composite jam signal is amplified and finally radiated off the antenna. This will continue until the CTLR reassigns the CPM.

The hand-off process allows the CTLR to find other possible threats while many of the CPMs work in the background independently to other CPMs to act and evaluate according to each assigned threat. The system is parallel processing which facilitates evaluating and responding to many targets simultaneously with great speed. The number of targets responded to depends primarily on the number of CPMs that are in the system, which implies the architecture is readily expandable by adding in more identical CPMs. The system could be delivered to the user with more CPMs than might be needed for the operational assignment, and should there be more signals than CPMs at any one time after field implementation, the CTLR would simply reassign the CPM with the oldest target hit.

The CTLR makes attack decisions based on a threshold which is comprised of current and previous historical data regarding frequencies, power level and intelligence. The CPMs process these factors in detail while handling a possible target and readily feed back the information to the CTLR's historical data bank—ie. the close-loop information path. Alternate embodiments may have specialized CPMs that can include other factors such as time and physical position of the target hits can be provided by Global Position System (GPS) technology interfaced back to the CTLR. For instance, the addition of a direction finder CPM can provide threat signal direction and origination, which can also be entered into the CTLR data bank to derive a more complete composite threshold decision for each hit frequency in the spectrum. This closed-loop architecture allows the invention to "learn" from the environment and avoid future "false triggers". This closed-loop characteristic is by definition a neural node since the invention is in fact learning—it can make non-linear threshold decisions using current and historical data, draw the necessary associations and then avoid future problem areas or frequencies.

The new architecture is also flexible enough that it could be implemented using either toggling between transmit and receive "look-through/peek-through" methods or by transmitting and receiving simultaneously while using noise cancellation techniques with the CPM's Digital Signal Processing technology to discern the target signal.

For the purpose of the present description, the abbreviated term "threshold" is to be equivalently understood as comprising a single parameter, or multiple parameters combined to create a composite threshold. The term "hostile" is to be understood as a signal that has been determined by the system to be a potential threat and should be jammed.

BRIEF DESCRIPTION OF DRAWINGS

FIG. 6 is a prior art block diagram of a Reactive Serial Processing Jammer (TDMC); and FIG. 7 is a prior art TDMC Timing diagram.

DETAILED DESCRIPTION OF THE INVENTION

Figure 1:
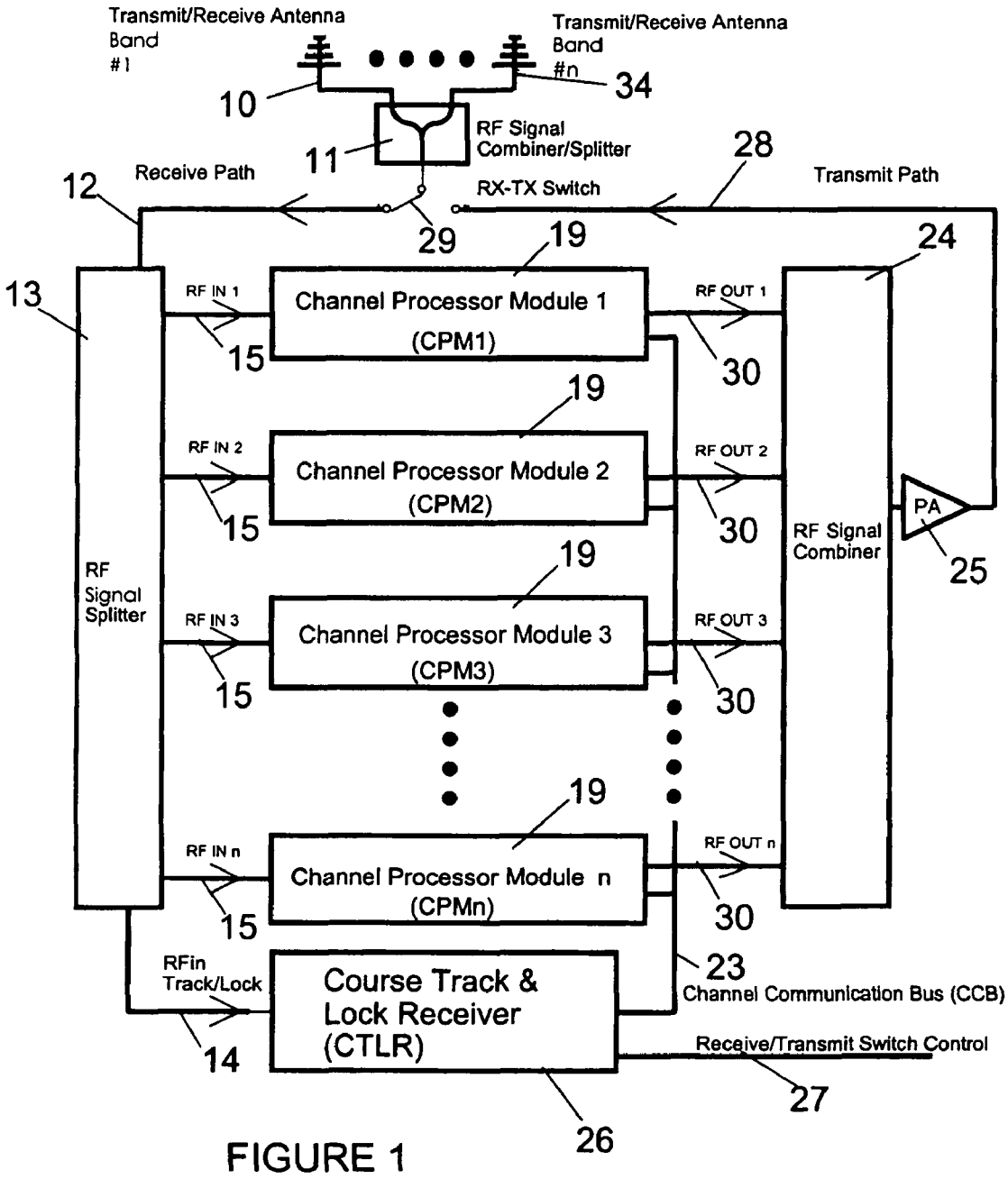
FIG. 1 is a block diagram of a preferred embodiment of the system of the present invention.

The system is a parallel processing jamming architecture which is designed to attack first and then concurrently investigate multiple signals simultaneously in the radio environment. The system facilitates responding and evaluating many suspect radio targets simultaneously with much faster speed than in prior art. The system is organized such that the front-line or initial response is detected by a very fast-scanning primary receiver/processor, here forth called the Course Track and Lock Receiver (CTLR 26), which uses a composite threshold to determine whether the signal in its received bandwidth is unusual. Upon this decision the CTLR 26 delegates the attack and investigative response to any one of many channel processors, here forth called Channel Processor Modules (CPMs 19). All CPMs 19 may have the same receive and transmit bandwidth as the CTLR 26 and are quickly tuned under the direction of the CTLR 26 to the suspected target frequency. Once a CPM 19 is assigned, and due to its receive/process/transmit architecture, the CPM 19 can immediately formulate a first response jam signal while concurrently listening to the target signal. This particular channel processor is then free to refine its jam algorithm independently of all other CPMs 19 until the CTLR 26 retasks this particular CPM 19. Once the CTLR 26 assigns a task to any CPM 19, the CTLR 26 immediately leaves the selected CPM 19 alone while it continues the rapid search for more suspect signals in its receive bandwidth. The CPM 19 may at a later time pass more detailed information back to the CTLR 26 via the Channel Communication Bus (CCB) 23 to augment the threshold level for that particular target frequency. All of the CPM 19 transmission outputs are then equally combined at low powers and sent onto the RF power amplifier stage 25 and finally onto the radiating antenna 10 or antennas 34. In this manner many possible hits may be co-processed and jammed without overloading any one individual processing module. All of these processes can operate in real-time and can attack an unusual signal within milliseconds of activation, accommodating the majority of commercially fabricated and publicly marketed radio control devices.

In order to cover a large breadth of radio bandwidth and signal variability proficiently this invention scans rapidly in frequency across the spectrum with minimal analysis until the CTLR 26 detects a signal that is unusual relative to a composite threshold for that frequency. The premise being that detecting a signal that is unusual yields the highest probability that the signal is hostile. The system bases its initial response to attack and investigate on whether a signal surpasses a composite threshold. With respect to using a threshold to initiate an action, much attention must be paid to the proper construction of the threshold itself to reduce the possibility of "false-hits". A false-hit is a non-threatening signal used for peaceful purposes that may initially appear as a hostile signal according to the threshold. Ideally, the threshold would never allow a false-hit, but that level of perfection is not realistic. Only upon subsequent investigation of additional facts can that distinction be made with greater reliability. Therefore this system is based on the concept of—attack first (based on a composite threshold) and ask questions while in attack mode. The subsequent answers are then digested by the system to ultimately create more reliable threshold levels—thereby allowing the invention to better distinguish what is ordinary and what is unusual in the radio environment. That is, the system has the capability to learn about the environment.

As seen in FIG. 1 the top level system architecture of the invention is shown in its basic form using the preferred a "look-through/peek-through" technique. Reception is engaged when the RF switch 29 is toggled to receive by the CTLR 26 using the RX/TX control line 27. When this occurs the radio spectrum that is within the bandwidth specification of the dual purpose (transmit and receive capability) broadband antenna 10 travels down the receive path 12, through the switch 29 and into a signal splitter 13. This signal splitter 13 equally divides the received spectrum into as many RF signal splitter outputs 15 as there are CPMs 19 plus one additional output 14 for the CTLR 26. The RF signal present on the input lines 15, denoted RF IN1, RF IN2 . . . RF INn in FIG. 1, and the signal on line 14 are identical and no intentional signal filtering is done until the signals reach either the CPMs 19 or the CTLR 26. Should the bandwidth capability be limited with one antenna 10 then several antennas 34 may be used and the signals may be combined using the RF signal combiner 11 prior to the RF switch 29.

Figure 2:
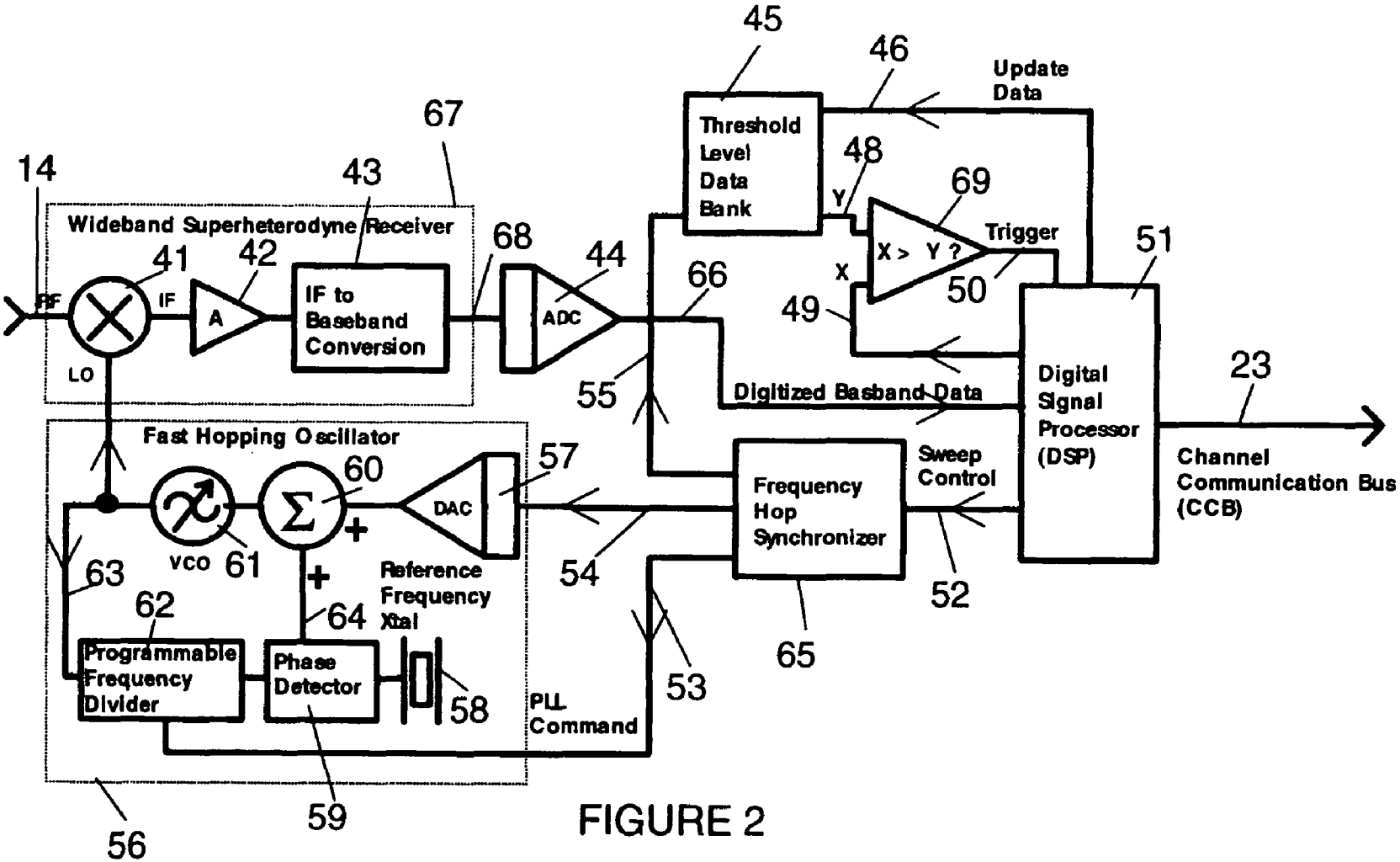
FIG. 2 is a block diagram of a Course Track and Lock Receiver/Processor, in accordance with a preferred embodiment of the present invention.

The CTLR 26 will provide the first level of discrimination as to which signal present on the input spectrum is to be targeted. This is accomplished by CTLR 26 performing a fast super-heterodyne sweep of the spectrum present at the splitter output 14. The sweep is in fact a quantized step in frequency, or frequency hop, and the size of each frequency step determines the CTLR's 26 processing baseband bandwidth. For instance if the CTLR 26 was to sweep 1000 MHz of spectrum and used 20 MHz frequency steps (baseband bandwidth is 20 MHz), then only 50 steps are required to sweep the entire range. The CTLR 26 must step to and stop for a moment at each frequency step to allow the CTLR's 26 processing electronics shown in FIG. 2 to examine in general detail what signals reside within this spectral swath of 20 MHz. The CTLR 26 processing functions will be examined later in the text. Should the CTLR 26 decide that a target be a valid hit based on its composite threshold, then the target frequency information is passed immediately on to one of the available CPMs 19 by way of a bi-directional bus CCB 23. This CCB 23 is connected from the CTLR 26 to all CPMs 19 in parallel to allow quick hand-off and feedback paths between any CTLR 26 and CPM 19 pairing. Once the CTLR 26 has chosen an available CPM 19 and handed off the target frequency and any additional information, the CTLR 26 will continue to sweep for more targets and leave the selected CPM 19 alone until the CTLR 26 retasks the CPM 19 for another target frequency.

In the meantime, once the target is handed off to the selected CPM 19, the CPM 19 initially transmits a first-response jam signal through its RF output 30 independently of all other CPMs 19 but only during the transmit portion of the "look-through/peek-through" cycle. This RF output signal 30 is then combined with all other CPM RF output signals 30 through the RF signal combiner 24 and finally amplified by the power amplifier 25. The RF jam signals that are present on the RF output lines 30, denoted as RF OUT1, RF OUT2 . . . RF OUTn in FIG. 1, are generally not identical if more than two CPMs 19 are concurrently active, since each CPM 19 will generate its own jam signal for its assigned task. The amplified composite RF signal 28 is then sent out to the antenna 10 or antennas 34 via the RF switch 29 and subsequent RF splitter 11 (if more than one antenna is used).

When the RF switch 29 toggles back to receive, the selected CPM 19 continues to examine the targeted radio signal with much greater precision and detail using its Digital Signal Processor (DSP) 79. The CPM 19 will first refine the frequency discrimination and target the most suspect signal within the target band of frequencies communicated to it by the CTLR 26. Once accomplished, the CPM 19 can proceed by demodulating and formulating a more effective jam signal. The process of signal demodulation, discrimination, formulation and jam signal synthesis is done primarily in the digital domain by the combination of the A/D converter 78, the DSP 79 and the D/A converter 80 in the CPM 19. The refinement of the jam signal improves the Jam to Signal (J/S) ratio which in turn means that the jammer can now be just as effective even with a proportional reduction in radiated RF power. Once formulation is accomplished, the first response jam signal is replaced by the newly synthesized jam signal at the input of the up-conversion stage 82 which is then remodulated to the target's same or offset frequency. A more detailed description of the CPM 19 realization is presented later in the text. Any information derived during the analysis that is relevant to the composite threshold 48 is then passed back to the CTLR 26 through the CCB 23 for historical cataloging. This is one of several ways the system's composite threshold 48 becomes more reliable.

As mentioned, the system is expandable to include more or less CPMs 19 depending on the operating environment. Initially the system would be delivered to the customer with as many CPMs 19 as required to handle the urban area where it will operate. If there are more target signals than CPMs 19 then the CTLR 26 will reassign the CPM 19 that is processing the oldest target signal.

The system's architecture is closed-loop in that the CTLR 26 makes a target hit decision at trigger output 50 when the composite received signal 49 surpasses the composite threshold level 48. The trigger output 50 is generated by the "X>Y?" comparator 69 where the value X in this case is represented by a multi-bit value of the composite received signal 49 and Y is represented by an equivalent dynamic range multi-bit value of the composite threshold 48. The composite threshold level 48 is dynamic and is constructed by constantly updating the Threshold Level Data Bank (TLDB) 45 with current and previous historical data regarding frequencies, power levels and intelligence provided by the CPMs 19. The CPMs 19 can process these factors in detail while handling a possible target and readily feed back the information to the CTLR's DSP 51 which is eventually reprocessed and routed onto the TLDB 45. All CPMs 19 need not be identical in function. Some of the alternate embodiments of the CPMs 19 can perform specialized analysis for such factors such as time and physical position of the target hits, using for instance commercially available Global Position System (GPS) technology, or any one of the CPMs 19 could also be a direction finding circuit for hit location or triangulation. These factors can be communicated by the CCB 23 to the CTLR's DSP 51 to derive a more robust composite threshold. The closed-loop architecture allows the system to "learn" from the environment and minimize "false triggers". This closed-loop characteristic is by definition a neural node since the system is in fact learning—it can make non-linear threshold decisions using various historical and current data to draw the necessary associations in order to avoid future problem target frequencies.

Since the preferred embodiment is using the "look-through/peek-through" technique, once one or more CPM's 19 have been activated and are sending out a jam signal, the RF switch 29 must be toggled repetitively to allow for a small period of reception time and a small period of jam transmission time. The toggling rate should be equal to or greater than the Nyquist rate for the CPM's 19 receive signal bandwidth to reduce anti-aliasing distortion in both the incoming target signal present at the input of the A/D converter 78 and the outgoing jam signal present at 30. As signal bandwidth increases, so too must the switch rate. Toggling back and forth at high speeds (6 kHz and up) puts considerable strain on the transmit/receive switch 29 (usually a PIN diode switch) as higher and higher RF powers are switched. However an advantage in this system is that as Jam to Signal ratios are increased during CPM 19 jam signal optimization, the final RF power amplifier 25 and the RF switch 29 may be reduced in capability without sacrificing the jammer's effective range. As will be mentioned in the alternate embodiments, the system could avoid using one very expensive common power amplifier 25 and antenna 10 and instead use a smaller power amplifier 83 in each CPM 19, and directly couple this output into an antenna. There would be at least one antenna for every CPM 19 Different antennas could take care of different spectral bandwidths.

The CTLR 26 is capable of hopping over all frequencies concerned in a linear or non-linear frequency stepped fashion. In the preferred embodiment seen in FIG. 2, the CTLR 26 uses a fast frequency hopping local oscillator module 56 which incrementally hops or steps to equally spaced frequencies over the bandwidth of the voltage controlled oscillator (VCO) 61. A certain dwell time at each hopped frequency is used to settle the frequency stability of the hopping oscillator 56 before any analysis can be done. The output of the hopping oscillator 56 is then used to convert the input radio signal to a baseband frequency by method of a wideband super-heterodyne receiver 67 where the down-conversion is generally represented by a wideband mixer section 41, filter-amplifier section 42 and the intermediate frequency to baseband conversion section 43. The analog baseband output is then presented at 68.

The sweeping oscillator module 56 is intended to be hopped over the same breadth of frequency as the receive bandwidth, at very fast speeds and maximum stability for all hop frequencies. In order to hop or sweep the voltage controlled oscillator (VCO) 61 at high speeds, a preferred embodiment 56 is shown. For large frequency steps the VCO is stepped over a relatively large range of voltages using a large dynamic range, fast settling time D/A Converter (DAC) 57. (DAC) 57 is driven by the DAC Control Bus 54 controlled by the Frequency Hop Synchronizer (FHS) 65. After the large hop is complete, the fine tuning and frequency/phase lock is accomplished by the phase lock loop comprised of 58, 59, 60, 61, 62, 63, 64 which is again under the direction of the FHS 65 through the PLL Command 53. The summation component 60 combines the DAC 57 output voltage with the phase detector output 64, and the voltage output of the summation component 60 drives the VCO 61. Alternatively, other types of technology could be employed to improve the hopping oscillator 56 such as a Direct Digital Synthesis (DDS) integrated based circuit which would have less signal purity but exceptionally fast frequency tuning ability. This yields smaller dwell times at each hop increment and thus faster sweeps of the entire receive bandwidth.

The baseband signal analog output 68 of the super-heterodyne receiver 67 is then digitized in real-time by an Analog to Digital Converter (ADC) 44 which yields the digitized baseband data at 66. The sampling rate of the ADC 44 must, by Nyquist sampling theorem, be at least twice as high as the highest frequency in the baseband to prevent anti-aliasing distortion of the input signal. Assuming the DSP 51 was to perform a power level spectral analysis of the baseband analog output 68, then for example, if the baseband bandwidth was 20 MHz wide, the ADC 44 must sample at 40 MHz or greater. These quantized samples of data at 66 are then streamed into a Digital Signal Processor (DSP) 51 for further processing, in particular a Fast Fourier Transform (FFT) is performed on the data to derive all the frequency components within the received baseband 68. The designer may choose frequency resolution by changing the number of sampled real-time points of the incoming baseband signal at 68. For instance, if a 1024 point FFT was chosen, then the 20 MHz baseband signal at 68 could be spectrally broken down to an approximate resolution of 20 kHz per bin. And due to the speed of current day DSP technology, processing a 1024 point FFT for a 20 MHz slice of bandwidth could occur in less than 50 microseconds. In fact the entire receive spectrum, in one sweep, could be reduced and recorded as a juxtaposed series of FFT bins in a very short period of time. Taking the example further, if the receive bandwidth present at RF input 14 is 1000 MHz, the DSP 51 could record this spectrum in a data bank as a set of 50 frequency steps of 20 MHz, and each step comprised of 1024 bins yielding 51,200 bins and having a frequency resolution of about 19.5 kHz per bin. Each bin, depending on the ADC 44 may have nominally 14 to 18 bits of amplitude range (85 to 110 dB) if the ADC 44 is fast enough to sample at a 40 MHz or greater speed. If one calculates the time per full spectral sweep, this can be less than 3 milliseconds/sweep, which readily captures many real-time signal amplitude transients in the environment, man-made or natural.

The real-time digitized baseband output 66 can be analyzed for several factors such as power spectrum, intelligence or other, and can then be combined using the DSP 51 with data from the CPMs 19 via CCB 23 in order to arrive at a composite received signal level 49. Activation of the trigger output 50, coming from the output of the comparator 69, can only happen when the composite receive signal level 49 surpasses the composite threshold level 48 which is presented by the TLDB 45. The TLDB 45 contains a corresponding composite threshold level 48 for each frequency hop across the entire sweep. The composite threshold values are being constantly updated by the DSP 51 and the CPMs 19 through any relevant combination of historical and current data such as ambient power, ambient intelligence, position, direction, time and so forth. The threshold update path 46 for the TLDB 45 is asynchronous to the frequency hopping. However, access to a particular composite threshold value is synchronous to the frequency hopping. The FHS 65 adjusts the hopping oscillator 56 and the TDLB 45 synchronously so that as the entire receive spectrum is swept, the received composite signal 49 is always compared to the corresponding composite threshold level 48. Upon triggering at output 50, the DSP 51 will stop the sweep using the sweep control 52 which in turn stops the frequency hop synchronizer 65 at its current hop frequency. The DSP 51 then hands off target frequency information to any one of the CPMs that are available to carry the analysis further. Should any of the CPMs 19 have any further information to augment the composite threshold for the corresponding target frequencies, it will communicate this through CCB 23. The CPMs 19 in effect operate as background research workers to help the CTLR 26 administer their jobs better.

Some possible electronic technology that can perform the various sub-modules tasks in CPM 19 are as follows:

ADC 44—Texas Instruments part no.: ADS5500; 14 bit/125 MSPS

DAC 57—Texas Instruments part no.: ADS5674; 14 bit/400 MSPS

TLDB 45—Dual Port SRAM, Cypress Semiconductor part no.: CYM1841-PZ

X>Y? 69 (Comparator)—Programmable Logic Device; Altera part no.: EP900

DSP 51—Analog Devices part no.: ADSP-21061

Figure 5:
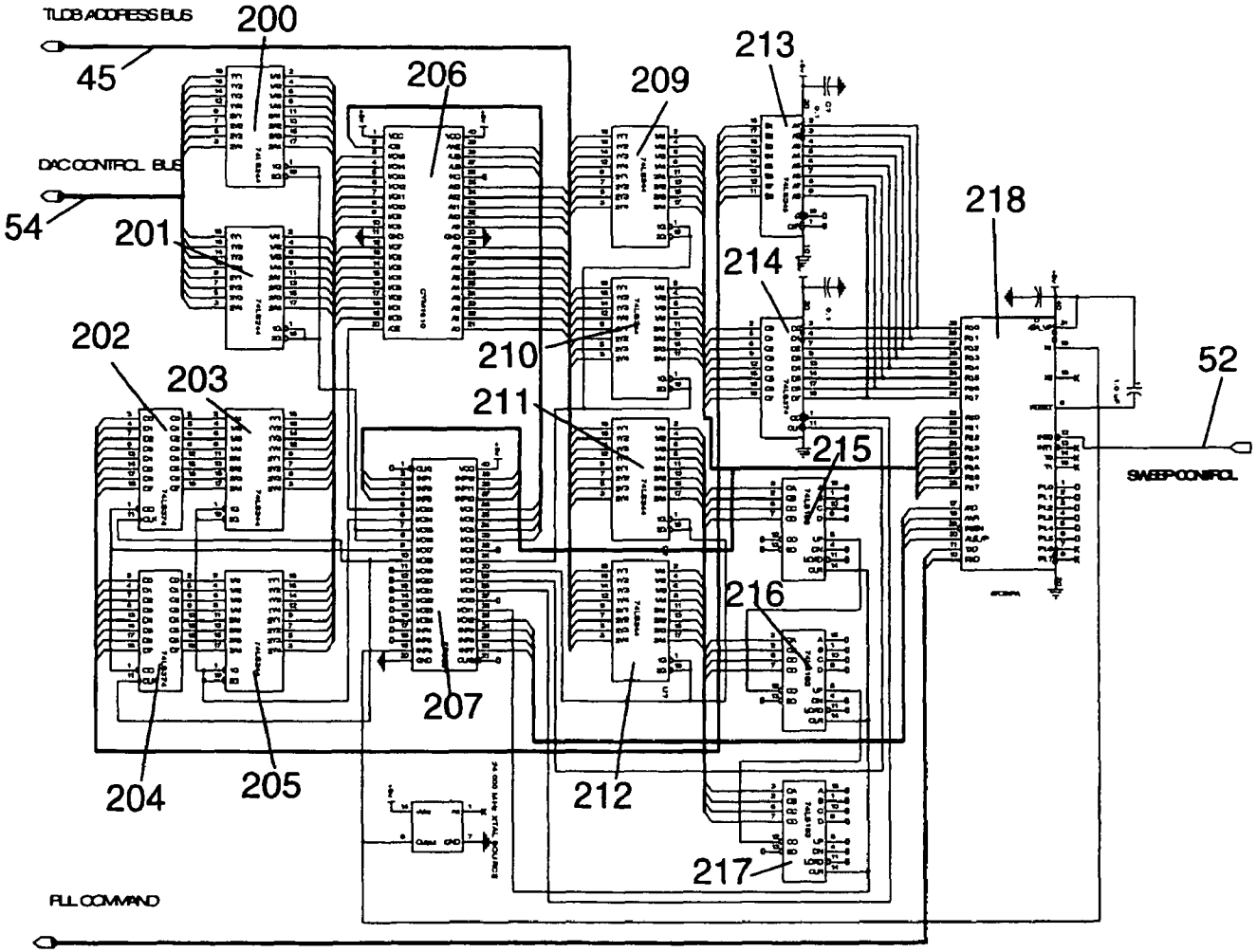
FIG. 5 is an electronic schematic of a Frequency Hop Synchronizer, in accordance with an embodiment of the present invention.

A possible embodiment of the Frequency Hop Synchronizer is shown in FIG. 5. Before operation can begin, the Intel microcontroller 87C51 218 will load a table of values into the dual port CYM 1610 SRAM 206 via TTL logic 74LS244 buffers 209, 210, 213, 214 for addressing the 16 bit 16 kB SRAM memory 206 and simultaneously load linearized data by way of 202, 204, 203, 205. The programmable logic device (PLD) 207 provides the necessary logic to clock in the appropriate data into the dual port SRAM 206. The data stored in the SRAM 206 is linearized since the VCO 61 will not be linear for incremental steps in the addresses generated by the address generator comprised of a chained arrangement of 741s193s 215,216,217. The outputs of the address generator 215, 216, 217 directly feed the 12 bit TDLB address bus 45 through the tri-state buffers 211,212 Once the linearized table is loaded at system startup, the microcontroller 218 using PLD 207 switches the FHS 65 operation to fast sweep mode. That is, the address generator 215, 216, 217 will rapidly generate addresses which will move the VCO 61 in linear succession using DAC Control Bus 54 with data provided by SRAM memory 206 through tri-state buffers 200,201 and is in lock step with the addresses which access the composite threshold in TLDB 45. In this manner, there is a unique correspondence between each VCO 61 hop frequency, which derives the received signal at 68, and the composite threshold which the composite received signal will be compared to. The fast scan stops the moment the Sweep Control 52 interrupts the microcontroller 218 which will stop the address generator 215, 216, 217 and will continue when the Sweep Control 52 releases the microcontroller 218. The PLL Command 53 is a standard I2C serial bus which can refine the hopped frequency by fine tuning the Fast Hopping Oscillator 56 using the phase lock loop of comprised of 58, 59, 60, 61, 62 if it is necessary.

Figure 3:
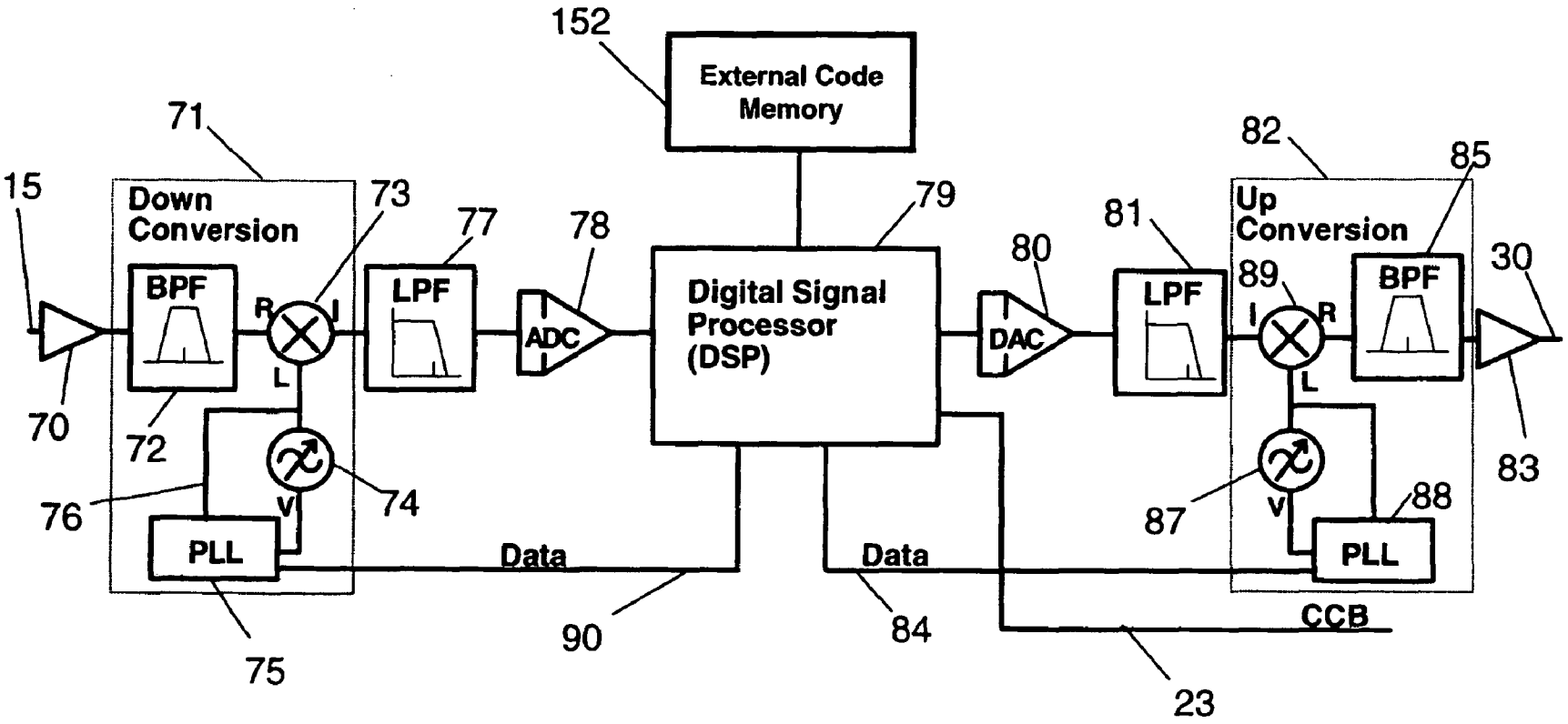
FIG. 3 is a block diagram of a Channel Processor Module, in accordance with a preferred embodiment of the present invention.

As seen in FIG. 3 the preferred embodiment of the CPM 19 is a self contained architecture which can receive, process and transmit a signal independently from the other CPMs 19 or the CTLR 26 if required. Each CPM 19 is fully capable of reception, demodulation, decryption, analysis, signal interference formulation, remodulation and transmission once it has been assigned a frequency target by the CTLR 26. Once the CUR 26 transfers this information by the CCB 23, the CTLR 26 does not need to maintain frequency lock and may continue sweeping other possible threats while the CPM 19 first attacks the target frequency with a general noise algorithm and then processes the target in the background. As mentioned, if the CPM 19 deduces any further important information, it is passed back to the CTLR 26 even while the CTLR 26 is mid-sweep.

The CPM's 19 receive portion is accomplished using a wideband amplifier 70 to establish receiver sensitivity and is then passed on to the super-heterodyne down-converter 71 which is generally represented by an optional bandpass filter 72 (for staggered CPM narrowband applications), a wideband mixer 73 for down-conversion and Phase Lock Loop (PLL) 75 circuitry. The down-conversion to baseband can occur over several stages if needed but if the ADC 78 is capable of fast sampling rates then fewer down-conversion stages will be needed. The down-conversion mixer 73 is driven by a local oscillator 74 which is guided by in this instance a PLL 75 using the feedback path 76 and tuned by the DSP 79 using data path 90. However in the CPM 19 design, there is no necessity to have a fast frequency hopping local oscillator as in the CTLR 26 since the CTLR 26 has already performed this first course level of target discrimination and will immediately supply the target frequency via CCB 23. However, the CPM's local oscillator 74 still must be capable of tuning over the same differential frequency range as the CTLR's hopping oscillator 56, but it may perform this task at reduced speeds in order to reduce costs and size of the CPM 19. Furthermore, since the CPM 19 is guided with relatively good precision to a target band the baseband bandwidth of the CPM 19 can be reduced. There are many benefits that arise from a reduction in bandwidth. For instance, the ADC 78 circuitry is simpler and does not have to sample with such great speeds, which in turn increases Signal to Noise Ratio (SNR), frequency resolution, dynamic range and reduces power consumption and cost all at the same time. The reduction in bandwidth can be done by reducing sampling speed of the ADC 78 and also proportional reduction in bandwidth of the anti-aliasing lowpass filter 77 just head of the ADC 78.

Quite often in communications, information is phase encoded so there may be real (I) and imaginary (Q) components in the received signal. Once again the CPM 19 receiver design can be readily modified to allow for this feature. However this technique will require at least two or more ADCs in each CPM 19 to demodulate the incoming data stream, and two or more DACs to remodulate the output data stream.

After the analog time domain signal after the lowpass filter 77 has been digitally sampled by the ADC 78 it is passed on to the DSP 79 which operates in one of several modes, and not necessarily in this sequence.

Mode 1; Frequency Analysis: The DSP 79 can be programmed to perform digital filtering, and an FFT analysis on the input signal similar to, but with greater resolution than, the CTLR DSP 51. The baseband at the output of the down-converter 71 and after digitization by ADC 78 can be divided into very fine frequency bins by DSP 79 and then can examine which frequency bin (or bins) are being alarmed. Internal to the DSP 79, the software can examine (Mode 2) the signal for as a long as it wants until the CTLR 26 reassigns the CPM 19 to another target. The CPM 19 can therefore use proprietary algorithms to build a threshold level data bank for the baseband and continually compare values to discern which frequency or frequencies should be targeted. The DSP 79 can adjust the targeting in real-time if other threats occur in the same baseband bandwidth slice.

Mode 2; Demodulation/Decryption: Once the DSP 79 is locked onto the most suspicious target, it may perform a demodulation analysis to derive the actual time domain decoded information. The demodulation analysis would discern whether the signal is, for instance, AM-DSB, AM-SSB, AM-SC, FM, PM, FSK, QPSK, AM-PCM, SS or a host of other formats. As new formats become available, the DSP 79 can be easily updated to accommodate the changes without any significant hardware changes. The DSP 79 may also be preprogrammed with decryption algorithms to more easily employ a more effective noise algorithm in Mode 4. This is entirely software dependent and can be updated without any significant hardware changes.

Mode 3; Intelligence Analysis: In real-time the DSP 79 can perform analysis in conjunction with Mode 1 on signal intelligence content and use proprietary algorithms to determine whether the suspect signal is a threat or not. In the event the signal is not a threat, the DSP 79 can stop working on the target hit to conserve power, or continue analysis until the CTLR 26 reassigns the CPM 19. In either case this information can be transferred back to the CTLR 26 to augment the composite threshold level.

Mode 4; Noise Algorithm: In real-time the DSP 79 may perform a formulation for the most effective jam algorithm, or if the CTLR 26 has just handed off the assignment to the CPM 19, draw from a pre-programmed arsenal of algorithms. The DSP 79 again can continually refine the jam algorithm until such time the CTLR 26 (DSP 51 specifically) reassigns the CPM 19 (DSP 79 specifically) or until another target or the target becomes no longer a threat. In fact the DSP 79 can generate a very complex noise algorithm in a very short period of time in order to trick the jammed receiver.

Mode 5; Remodulation: The derived jam algorithm can then be digitally filtered and then digitally remodulated by the DSP 79 in exactly the same manner as it was demodulated. The DSP 79 can also decide to either offset the frequency, as done for instance in cellular telephone communications, or maintain the frequency as is done in many handy talkie communications.

Mode 6; Multi-Target Detection: The DSP 79 continually refines the search for other threats within the same baseband at the output of down-converter 71. The DSP 79 is looking for decoy anomalies and secondary targets which can often exist. The information can be sent back to the CTLR 26 via the CCB 23 to further refine its threshold level data bank 45.

As more capable or complicated software is introduced, or more modes of operation are required, a provision is made to store the new code in external memory 152 if the DSP 79 memory resources have been exhausted.

The digital noise algorithm at the output of the DSP 79 can then be brought back into the analog domain by a Digital to Analog Converter (DAC) 80 if the signal is not phase modulated. The sampling speed must again be at least twice as high as the highest frequency in the baseband. Should the jam signal need to be modulated with phase, then at least two DACs will be required. The output of the DAC 80 is then passed through typically a band limiting Low Pass Filter 81 and further to super-heterodyne up-converting circuitry 82 to the target frequency as determined by the DSP 79. The up-conversion circuit 82 works in a similar fashion to the down-conversion circuit 71 but depending on the frequencies targeted by the DSP 79, the DSP 79 may decide to offset the transmit frequencies (Mode 5) and program PLL 88 through the data path 84 to frequency offset the local oscillator 87. The frequency translated output would appear after the up-mixer 89 and optional post bandpass filter 85.

In regards to system timing the invention arranges each noise channel (inherent to each CPM 19) by a parallel configuration which may be termed Frequency Division Multiplexed Channels (FDMC). This means the architecture allows the simultaneous operation of multiple noise channels (CPMs 19) which can operate independently in frequency, noise bandwidth, noise type and so forth. This implies a high degree of parallelism in order to process one or more target signals at the same time.

Figure 4:
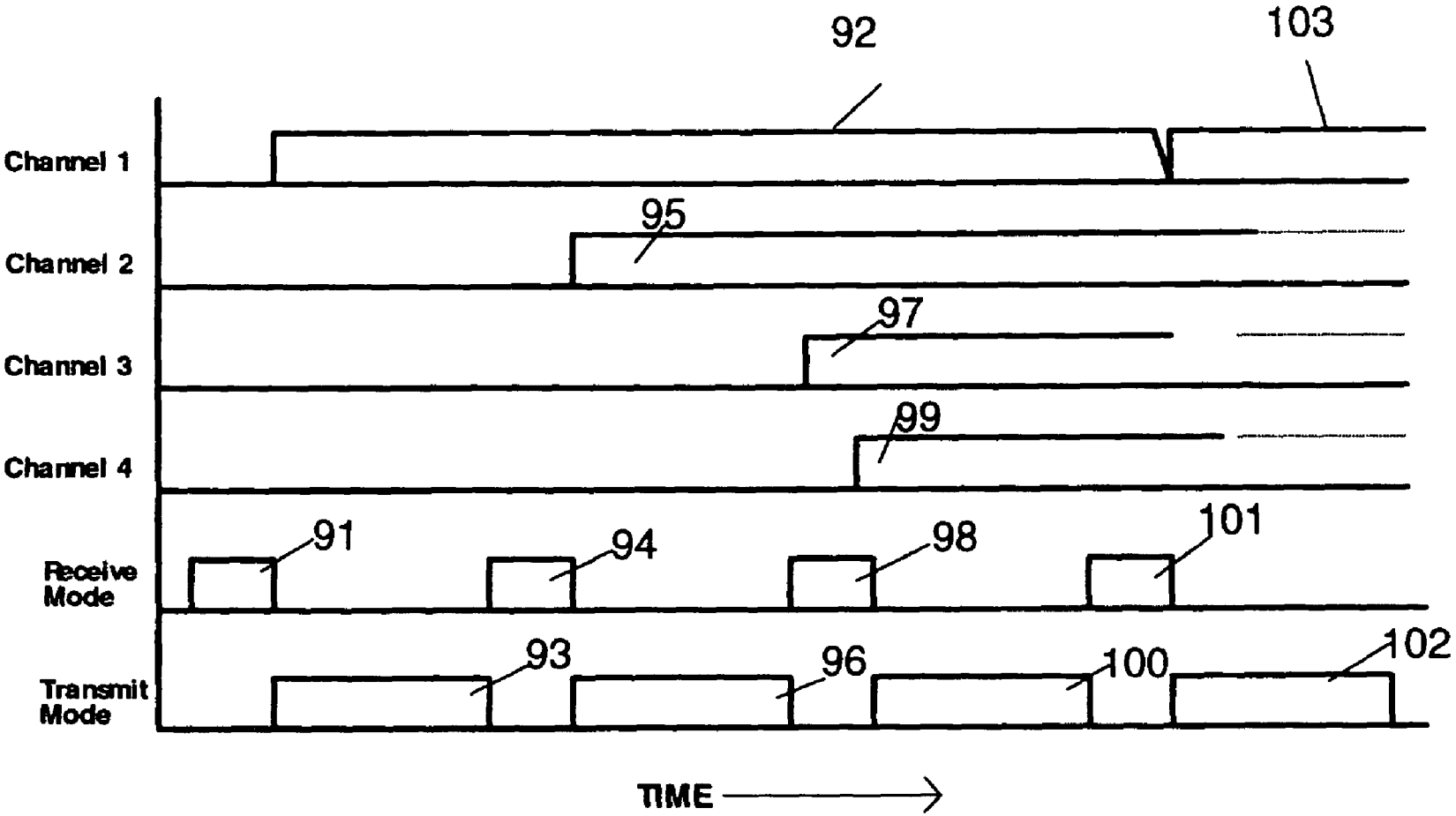
FIG. 4 is an FDMC Timing diagram.

As an example, configuring the system into a four channel system (CPM1 19, CPM2 19, CPM3 19, CPM4 19), the timeline can be seen in FIG. 4. The abscissa is represented by time and the ordinate by a composite of signals where Channel 1 is the activity level of CPM1 19, where Channel 2 is the activity level of CPM2 19 and so forth. Receive Mode represents when the complete system is operating as a receiver and Transmit Mode when the complete system is operating as a jamming transmitter. Assuming no hits are being processed by all the CPMs 19 at the beginning of the timeline, the CTLR 26 will sweep and analyze the input receive spectrum shown at 91 until the trigger output 50 is activated. At this moment the first CPM1 19 is assigned by the CTLR 26 through CCB 23. CPM1 19 produces an output in FIG. 4 which represents the CPM's 19 activation level at 92. CPM1 19 sends out a first-response noise signal which is combined 24 and amplified 25 and sent out through switch 29 and antenna 10. The signal 93 represents the transmission of CPM1 noise only off the radiating antenna 10. During the next receive cycle 94, the CTLR 26 scans in frequency up to the next hit, where it stops and assigns CPM2 19. CPM2 19 then begins to become active 95 along with CPM1 19 at 92. CPM1 19 is still working on the original hit optimizing its jam algorithm at 92. The next transmit cycle at 96 will have the combined outputs of 92 and 95 being transmitted off the antenna 10. At the next receive cycle, the CTLR 19 finds two more targets during its sweep time 98 and delegates the new assignments to CPM3 19 at 97 and CPM4 19 at 99. Next transmission cycle at 100, all four channels are now active and working at their own target frequencies, transmitting their own independent noise signals. Finally after the following receive cycle at 101, the CTLR 26 finds another target hit and must reassign CPM1 19 to the new target at 103. Meanwhile CPM2 19, CPM3 19, CPM4 19 continue working on their assignments at 95, 97, 99 even while the system is transmitting again at 102.

By comparison, Prior Art reactive jamming technology using time division cyclic hopping is a serial technique. The technique, which can be termed Time Division Multiplexed Channels (TDMC), can also process multiple target signals, but they are all handled in sequential time at a certain frame repetition or cycle rate. The frame repetition rate must be fast enough so that each noise signal appears to the threat receiver as a relatively undistorted signal. A possible realization of this reactive jamming architecture is shown in FIG. 6 and the timing diagram can be seen in FIG. 7.

Assuming that no channels are active at the beginning of the timeline in FIG. 7, with the same ordinate and abscissa specifications as in FIG. 4, and the transmission/reception uses the same antenna 111, during the receive cycle 142 when the switch 112 is set to the receive path 113, the frequency hopping oscillator 120 has also switched over at 121 and thus the super-heterodyne converter 114 brings the signal down to a digitally sampled baseband at 125 for analysis by the processor 119. The processor 119, during the receive cycle, picks up four target hits, for example. During transmission, the switch 112 must be in the transmit path, and the oscillator switch 121 must be toggled over to produce the up-converted noise generator RF signal at 129. The oscillator must hop during the transmit on time during 132 to all four channel frequencies 131, 133, 134, 135 and at each channel frequency must produce the correct noise type and bandwidth for transmission. This could accomplished by the processor 124 programming the noise parameters through data bus 124 and then feeding the local oscillator 120 through switch 121 to up-convert the baseband noise generated by modules 123,126, 127 through up-mixer 128 to yield the jam signal at 129. Then it falls back to receive mode at 136 for a period of time, and then the system repeats transmission during 138 using the four channel jamming at 137, 139, 140, 141. The frame repetition period 143 must be short enough that the signal perceived by the hostile receiver is seen as relatively undistorted. This is a pitfall with this technology since as more channels are added, less time is spent on each channel to satisfy the Nyquist sampling rate. As well, experiments have shown that as more channels are introduced the noise signal 129 for each channel will begin to show much more distortion than some commercially made radio control devices can tolerate, (which could lead to premature device actuation) even though it may satisfy the Nyquist sampling rate. Furthermore there is less time for the processor to optimize a jam algorithm for each channel since less time can be spent at each channel frequency during the cycling.

Some possible electronic technology that can perform the various module tasks shown in the CPM 19 are as follows:

ADC 78—Texas Instruments part no.: ADS5500; 14 bit/125 MSPS

DAC 80—Texas Instruments part no.: ADS5674; 14 bit/400 MSPS

DSP 79—Analog Devices part no.: ADSP-21061

In an alternate embodiment, the CTLR 26 may also have a user interface to monitor, troubleshoot and manipulate any thresholds or other system parameters that may need to be manually overridden. The CPMs 19 may or may not be identical in function. It may be useful to add specialized CPMs 19 to aid in determining a more comprehensive composite threshold, such as the introduction of direction finder CPMs, GPS location CPMs, decryption CPMs or other functions. Some CPMs may be specialized for different parts of the spectrum whereas others may just deal with cellular telephone technology while others may deal only with radars for instance.

Also alternatively, the system may use a smaller final RF power amplifier 83 at the output of each CPM 19 instead of one large power amplifier 25 after combination 24. Each CPM's 19 RF power amplifier 83 could be directly combined through a low loss passive combiner which feeds a single broadband radiating element. Alternatively, this could done by using a separate broadband radiating element for each CPM 19 output. Unfortunately as more CPMs 19 are added to the system, the antenna array must grow larger in size and eventually the system would not be easily transportable. In either case this would lead to a channel distributed power amplifier system which would be highly efficient and have extraordinary advantages in terms of combined signal linearity, (reduced intermodulation products) and reduced signal distortion. The configuration would truly aid in making the system even more surreptitious.

Alternatively the system may have an antenna dedicated for reception and one or multiple antennas for transmission to eliminate the need for a high power wide band RF switch 29 as in the preferred embodiment.

Alternatively the system may be configured to operate without the RF switch 29 and have transmissions and reception occur simultaneously—without toggling between transmission and reception. This can be accomplished at low transmit powers using internal negative feedback within each CPM 19 and also CCB 23 feedback path between the CPMs 19 and the CTLR 26 to discern the true environment's RF spectrum from the jam spectrum. Or at higher transmission powers, the addition of a passive linear summation block installed in the Receive Path 12 where the output jam spectrum could be subtracted by amplitude phase inversion from the composite signal coming from the antenna and yield the environment's spectrum as well.

The system may have one or several antennas to cover the broadband capability of the system.

Alternatively, the system may be readily adapted for radar or other sensory applications, where the sensory receiver may be exposed to considerable background noise or other unrelated signals that fall within the receive band of the reactive sensory jamming system. This architecture would give the sensory jamming system the added advantage of being very selective of all the return echoes presented and due to its parallel architecture, jam only the ones, (process one or multiple targets simultaneously), which are deemed as hostile or threatening by the system.

While illustrated in the block diagrams as groups of discrete components communicating with each other via distinct data signal connections, it will be understood by those skilled in the art that the preferred embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present preferred embodiment.

The embodiments of the invention described above are intended to be exemplary only. The scope of the invention is therefore intended to be limited solely by the scope of the appended claims.

The invention claimed is:

1. A method for jamming communication signals, the method comprising:

scanning a spectrum and comparing detected signals in said spectrum to a threshold;

identifying a first signal which exceeds said threshold as a first potential threat;

sending a first response jam signal to said first signal identified as a first potential threat;

identifying a second signal which exceeds said threshold as a second potential threat, sending a first response jam signal to said second signal identified as a second potential threat;

analyzing, in parallel and independently, said first signal identified as a first potential threat, and said second signal identified as a second potential threat to further determine whether said first signal and said second signal are hostile signals; and formulating, in parallel and independently, based on said analyzing, a jamming algorithm for said first hostile signal and said second hostile signal, generating a first optimized jamming signal and a second optimized jamming signal using said jamming algorithm, and transmitting said first optimized jamming signal and said second optimized jamming signal in replacement of said first response jam signal for each one of said first hostile signal and said second hostile signal.

2. A method as claimed in claim 1, comprising updating said threshold using information obtained from said analyzing.

3. A method as claimed in claim 1, wherein said analyzing comprises determining a point of origin of said signal identified as a potential threat.

4. A method as claimed in claim 1, wherein said formulating comprises refining said jamming algorithm after said optimized jamming signal has been sent, generating an updated optimized signal, and transmitting said updated optimized signal.

5. A method as claimed in claim 4, wherein said analyzing comprises analyzing until a new signal is identified as a potential threat.

6. A system for jamming communication signals, the system comprising:

at least one receiving/transmitting module;

a control module for receiving data from said receiving/transmitting module and adapted to scan, from said data, an operational spectrum, and identify a signal as a potential threat based on said signal exceeding a threshold; and at least two channel processor modules, each adapted to transmit a first response jam signal to temporarily neutralize said signal identified as a potential threat, analyze said signal to further determine whether said signal is a hostile signal, formulate a jamming algorithm for said signal if said signal identified as a potential threat is found to be a hostile signal, generate an optimized jamming signal using said jamming algorithm, and transmit said optimized jamming signal in replacement of said first response jam signal, using said receiving/transmitting module, and said control module assigns a first potentially threatening signal to a first of said at least two channel processor modules, and assigns a second potentially threatening signal to a second of said at least two channel processor modules, and said at least two channel processor modules operate in parallel and independently from each other.

7. A system as claimed in claim 6, wherein said control module receives analysis data from said at least one channel processor module and updates said threshold accordingly.

8. A system as claimed in claim 6, wherein said at least one channel processor module comprises a global positioning system to determine a point of origin of said hostile signal.

9. A system as claimed in claim 6, wherein said at least one channel processor module refines said jamming algorithm after said optimized jamming signal has been sent, generates an updated optimized signal, and transmits said updated optimized signal.

10. A system as claimed in claim 9, wherein said at least one channel processor module continues to refine said jamming algorithm until said control module assigns a new signal identified as a potential threat to said at least one channel processor module.

11. A system as claimed in claim 6, wherein said at least one receiving/transmitting module comprises a plurality of transmit/receive antennae, each of said antennae being tuned to a different frequency band.

12. A system as claimed in claim 6, wherein said at least one channel processor module also receives said data from said receiving/transmitting module, and said control module instructs said at least one channel processor module to transmit a first response jam signal to temporarily neutralize said signal identified as a potential threat.

13. A method for jamming communication signals, the method comprising:

scanning a spectrum and comparing detected signals in said spectrum to a threshold;

identifying as potential threats a plurality of signals that exceed a threshold; and transmitting in parallel first response jam signals to neutralize said plurality of signals identified as potential threats;

analyzing, in parallel, said plurality of signals identified as potential threats to further determine whether said signals are hostile signals; and formulating, in parallel based on said analyzing, jamming algorithms for each one of said hostile signals, generating optimized jamming signals using said jamming algorithms, and transmitting in parallel said optimized jamming signals in replacement of said first response jam signals.

14. A method as claimed in claim 13, comprising updating said threshold using information obtained from said analyzing.

15. A method as claimed in claim 13, wherein said analyzing comprises determining a point of origin of said signals identified as a potential threats.

16. A method as claimed in claim 13, wherein said formulating comprises refining said jamming algorithms after said optimized jamming signals have been sent, generating updated optimized signals, and transmitting said updated optimized signals.

17. A system for jamming communication signals, the system comprising:

at least one receiving/transmitting module;

a control module for receiving data from said receiving/transmitting module and adapted to scan, from said data, an operational spectrum, and identify signals as potential threats based on said signals exceeding a threshold; and a plurality of channel processor modules instructed individually by said control module to transmit in parallel first response jam signals to temporarily neutralize said signals identified as potential threats, using said receiving/transmitting module, wherein said plurality of channel processor modules analyze said signals to further determine whether said signals are hostile signals, formulate jamming algorithms for said signals if said signals identified as potential threats are found to be hostile signals, generate optimized jamming signals using said jamming algorithms, and transmit in parallel said optimized jamming signals in replacement of said first response jam signals.

18. A system as claimed in claim 17, wherein said control module receives analysis data from said plurality of channel processor modules and updates said threshold accordingly.

19. A system as claimed in claim 17, wherein said plurality of channel processor modules refine said jamming algorithm after said optimized jamming signals have been sent, generate updated optimized signals, and transmit said updated optimized signals.

20. A system as claimed in claim 19, wherein each one of said plurality of channel processor modules continue to refine said jamming algorithms until said control module assigns a new signal identified as potential threat thereto.

* * * * *